US007293361B1

(12) United States Patent
Miller

(10) Patent No.: US 7,293,361 B1
(45) Date of Patent: Nov. 13, 2007

(54) HAND TOOL FOR CHOPPING ICE

(75) Inventor: Michael T. Miller, Edina, MN (US)

(73) Assignee: Ames True Temper, Inc., Camp Hill, PA (US)

( * ) Notice: Subject to any disclaimer, the term of this patent is extended or adjusted under 35 U.S.C. 154(b) by 285 days.

(21) Appl. No.: 11/123,286

(22) Filed: May 6, 2005

Related U.S. Application Data

(60) Provisional application No. 60/569,350, filed on May 7, 2004.

(51) Int. Cl.
*F25C 5/00* (2006.01)
*B25D 3/00* (2006.01)

(52) U.S. Cl. ..... 30/164.6; 30/169; 173/90; 173/202; 173/211

(58) Field of Classification Search ..... 30/164–164.8, 30/168, 169, 171–173, 335, 272.1, 277, 167–167.2, 30/DIG. 5; 15/236.05, 236.01, 236.06, 93.1; 173/114, 131, 121, 90, 91, 51, 128, 202, 211; 125/40; 241/DIG. 17; 7/143–145; 81/463; D7/682; 294/50.5, 51; 172/18, 132, 48; 254/19

See application file for complete search history.

(56) References Cited

U.S. PATENT DOCUMENTS 476,052 A * 5/1892 Loftus ..... 30/142
1,032,370 A * 7/1912 Bayley ..... 30/277
1,041,605 A * 10/1912 Deininger ..... 30/164.8
1,103,132 A * 7/1914 Deininger ..... 30/164.7
1,229,732 A * 6/1917 Erickson ..... 30/277
2,232,367 A * 2/1941 Cherry ..... 30/169
2,422,005 A * 6/1947 Louis ..... 452/147
2,485,877 A * 10/1949 Hamilton, Jr. ..... 30/277
2,535,253 A * 12/1950 Anders ..... 30/128
4,452,316 A * 6/1984 Edwards ..... 172/41
5,010,647 A * 4/1991 Gray ..... 30/169
5,040,614 A * 8/1991 Nash ..... 172/18
5,435,063 A * 7/1995 Russo ..... 30/164.5
5,849,856 A * 12/1998 Kawamura et al. ..... 528/49
7,021,395 B1 * 4/2006 Coppock ..... 172/371
2004/0123470 A1 * 7/2004 Gray ..... 30/169
2007/0006414 A1 * 1/2007 Sorensen ..... 15/236.01

* cited by examiner

*Primary Examiner*—Boyer D. Ashley
*Assistant Examiner*—Laura M. Lee
(74) *Attorney, Agent, or Firm*—David C. Jenkins; Eckert Seamans Cherin & Mellott, LLC

(57) ABSTRACT

An ice chopper having a blade for initially engaging ice with a small force followed by an impact of a larger force to break up the ice. The ice chopper has a tube for a handle having a second tube inside with a compression spring. The second tube has a blade attached, which engages ice and pushes the second tube up inside the tube simultaneously compressing the compression spring. When a stop is reached the second tube stops retracting and the impact force of the downward movement of the tube is absorbed by the blade for breaking the ice. The ice chopper is then lifted off the ice, the compression spring pushes the second tube and the blade downward and the ice chopper is ready for another stroke. An ergonomic handgrip is attached at the top of the tube for gripping the ice chopper.

5 Claims, 3 Drawing Sheets

HAND TOOL FOR CHOPPING ICE

CROSS-REFERENCE TO RELATED APPLICATION

This application claims priority under 35 U.S.C. 119(e) to U.S. Provisional Patent Application Ser. No. 60/569,350, filed May 7, 2004, entitled "HAND TOOL FOR CHOPPING ICE."

BACKGROUND OF THE INVENTION

I. Field of the Invention

This invention relates generally to yard tools, and more particularly to an improved hand tool for chopping ice from sidewalks and driveways.

II. Discussion of the Prior Art

During winter in colder climes, a problem arises when snow melts and then refreezes on driveways and sidewalks. Ice patches can be hazardous and are the cause of many slip and fall accidents. The melting and refreezing of snow creates ice patches that adhere strongly to the underlying concrete or asphalt surfaces of sidewalks and driveways.

A typical prior art ice chopper comprises an elongated wooden handle having a sheet metal blade affixed to one end thereof where the blade may be trapezoidal in shape having a lower edge that extends perpendicularly to the axis of the handle. In use, the upper end of the handle may be grasped in one or both hands and repeatedly raised up and down with the bottom edge of the blade striking the ice surface on each down stroke. Depending upon the thickness of the ice layer and how intimately it is engaged with the underlying concrete or asphalt, it may take many, many blows of the chopper blade to crack and chip away the buildup of ice.

It is the object of the present invention to provide an improved ice chopper that more efficiently and effectively can be used to break up layers of ice so that it can be scraped or shoveled off of walkways and the like.

SUMMARY OF THE INVENTION

In accordance with the present invention, the ice chopper comprises an elongated tubular metal handle that is rigidly affixed to a first chopper blade member. Disposed within the tubular handle is a rigid rod that is spring-biased tending to urge the rod downward and out the lower end of the tubular handle. Affixed to the lower end of the spring-biased rod is a second blade member that is slidingly secured to the first blade member by means of bolts that pass through elongated slots formed in the second blade member and through threaded bores formed in the first blade member.

In use, the user will grasp the outer tubular handle proximate its upper end and using his/her arms will plunge the chopper tool in a vertical motion, or at an angle to the surface of the ice, with the first chopper blade impacting the ice layer, followed immediately by a pulse as the second blade secured to distal end of the rod impacts on the first blade impulsing the first blade on the ice. It is believed that the combination of blows in rapid succession produce harmonics in the pressure waves traveling through the ice that aids in the disintegration of the ice.

DESCRIPTION OF THE DRAWINGS

The foregoing features and advantages of the invention will become apparent to persons skilled in the art from the following detailed description of the preferred embodiment of the invention, especially when considered in conjunction with the accompanying drawings in which.

DESCRIPTION OF THE PREFERRED EMBODIMENT

Figure 1:
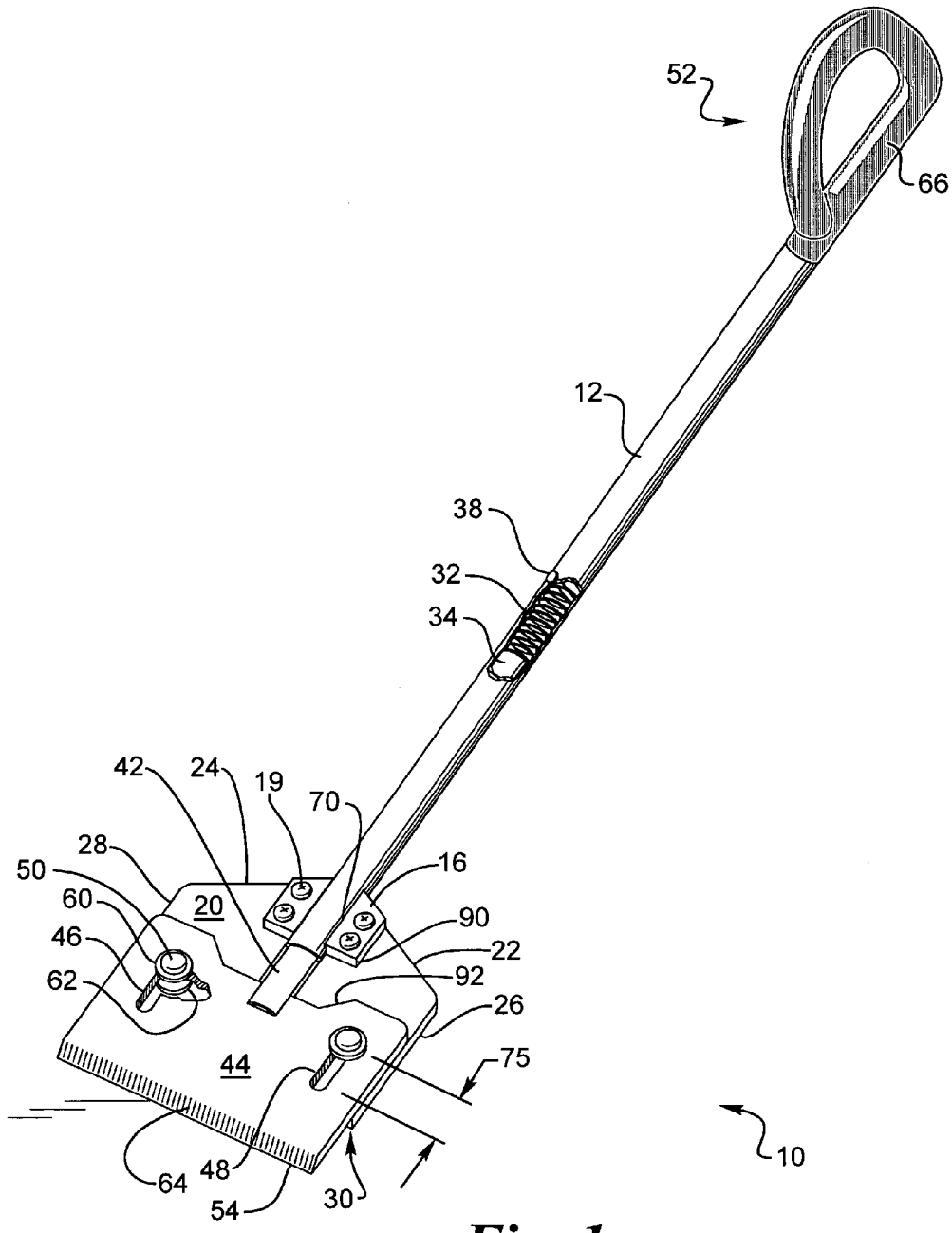
FIG. 1 is a perspective view of a prototype of the bottom side ice chopper of the present invention with the second blade extended.
Figure 2:
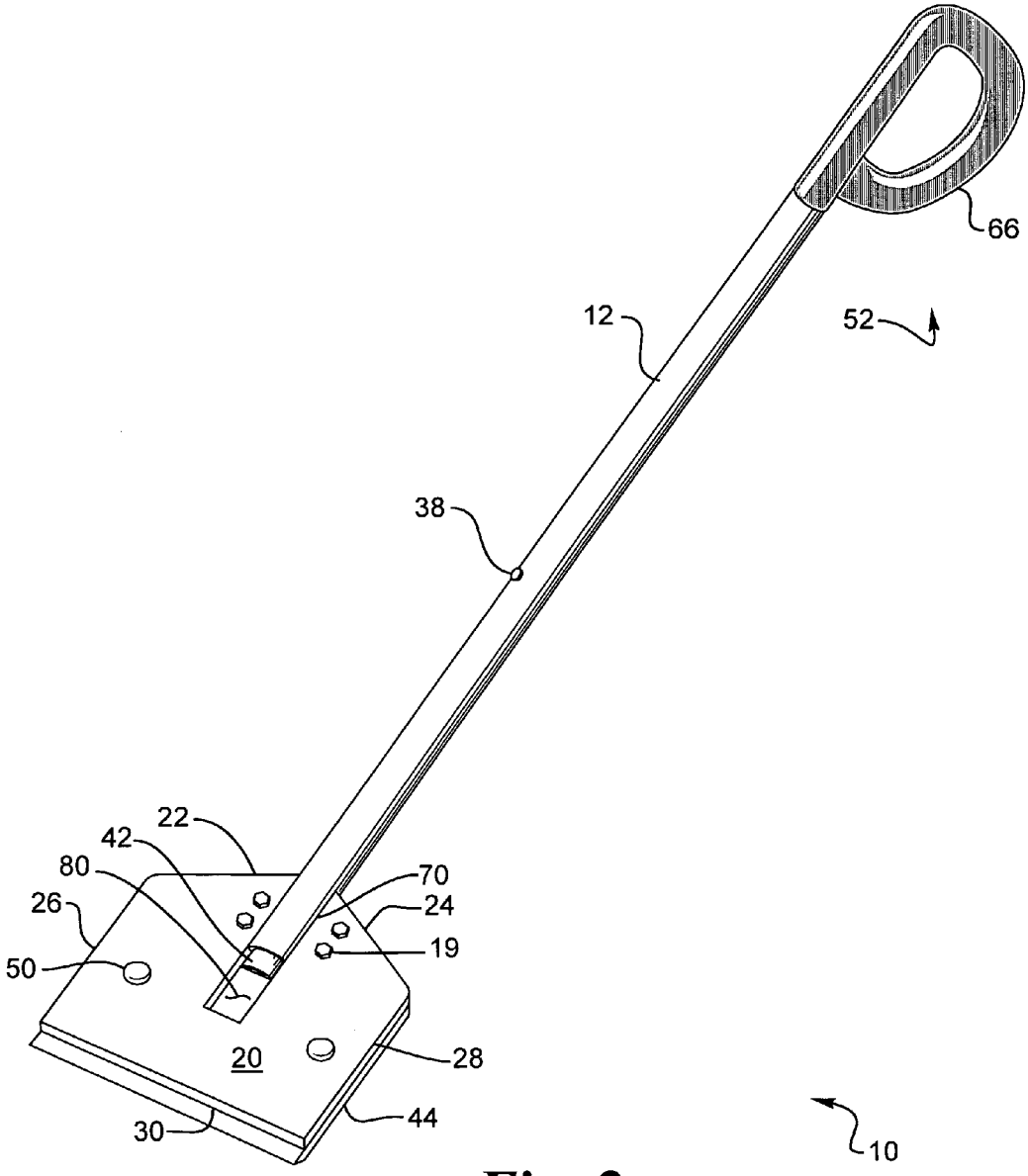
FIG. 2 is a perspective view of the top portion of the ice chopper constructed in accordance with the present invention with the second blade retracted.

A preferred embodiment of the improved ice-chopping tool is indicated generally by numeral 10. It is seen to comprise an outer tubular handle member 12 and welded 70 to its outer surface proximate the distal end 14 thereof is a bracket 16 having a plurality of bolt receiving holes 18 extending through it. Affixed by fasteners such as bolts or rivets 19 to the bracket 16 is a first blade member 20, here shown as a polygon having first and second sloped top edges 22 and 24, opposed side edges 26 and 28 and a bottom edge 30. First blade member 20 has a slot 80 at the top center for allowing tube or rod 36 to move up and down without interference. While the blade 20 is shown as being attached by fasteners such as bolts 19 through apertures 58 to a bracket 16 welded 70 to the outer tubular handle 12, it is also envisioned that the blade member 20 may be directly welded to or otherwise affixed proximate the distal end 14 of the handle 12 Contained within the lumen of the outer tubular handle 12 is a relatively stiff compression spring 32 on the order of 15.24 centimeters (6 inches) long that cooperates with the proximal end 34 of an elongated steel rod or tube 36. The spring 32 may be held in place within the lumen of the outer tube 12 by means of a fastener such as bolt or rivet 38 that passes through aligned apertures 40 drilled through the outer handle 12. As can be seen, the inner rod or tube 36 has its distal end 34 extending out from the distal end 14 of the outer tube 12. Affixed to the distal end of the inner rod or tube 42 is a second blade member 44 which is also in the shape of a polygon. The second blade member 44 includes first and second parallel slots 46 and 48 that also extend parallel to the axis of the tubular handle 12. The second blade 44 may be welded 72 or otherwise affixed to the distal end 34 of the inner tube or rod 36. Shoulder bolts or rivets 50, pass through the slots 46 and 48. Shoulder bolts may pass into threaded bores (not shown) formed in the first blade member 20.

Figure 3:
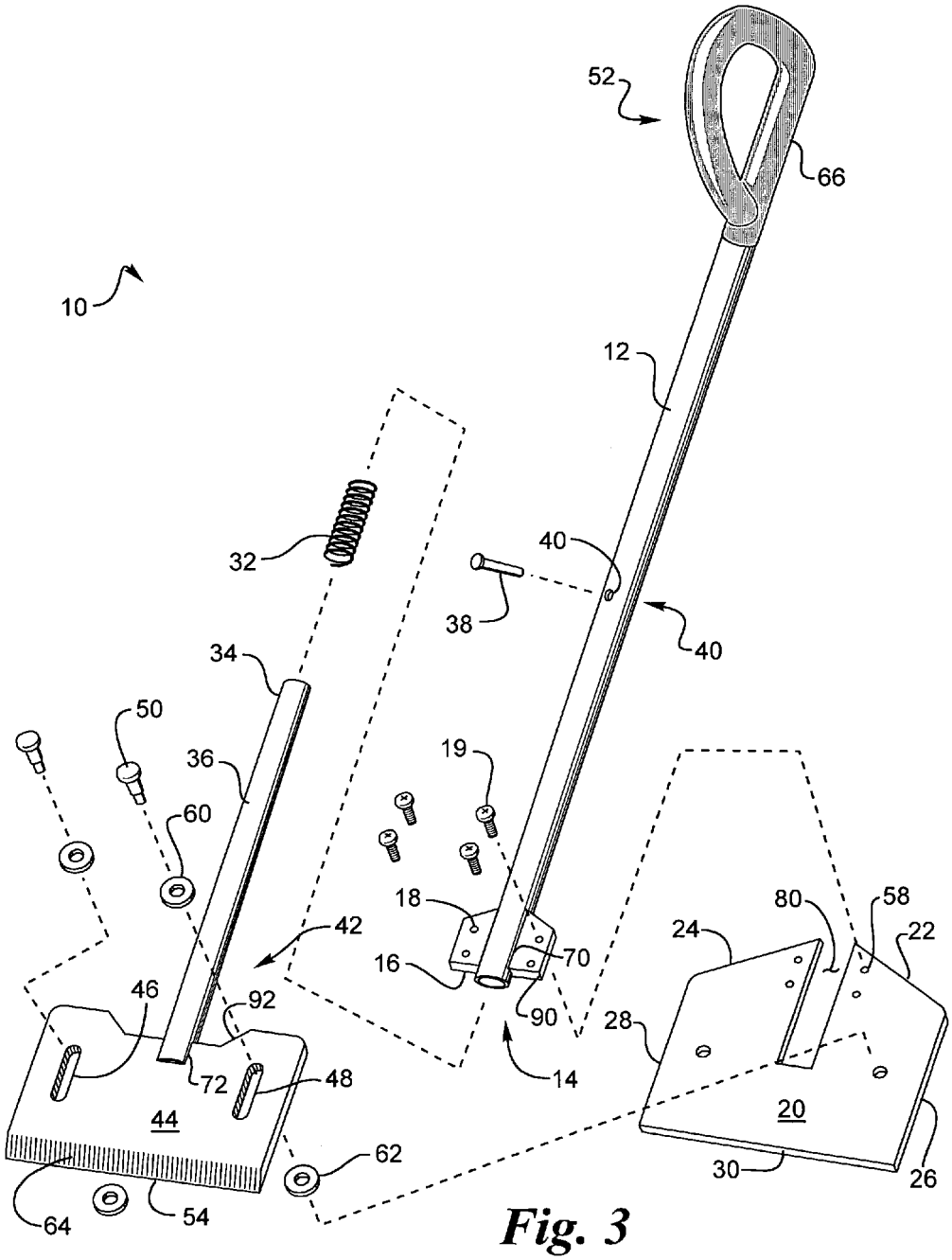
FIG. 3 is an expanded view of the blade assembly.

As best seen in FIG. 3 a washer 62 preferably a lubricated washer, between the first blade 20 and the second blade 44 allows the blades to move relative to each other without much frictional interference. Similarly washer 60 is preferably lubricated to reduce friction of the fastener such as rivet or bolt 50 with second plate 44.

A handle grip 52 having a gripping material applied 66 extends generally perpendicularly to the axis of the shaft 12 at the upper end thereof. Without limitation, the outer tubular handle portion 12 may be from about 101.6 centimeters to about 127 centimeters (40 to 50 inches) in length and the grip portion 52 may extend out about 15.24 centimeters (6 inches) from the tubular handle portion 12. Again, without limitation, the blades 20 and 44 may be formed from cold rolled steel approximately 0.3175 centimeters ($\frac{1}{8}^{th}$ inch) in thickness. The lower edge 54 of the second blade 44 may extend approximately 3.8 centimeters (one and one-half inches) beyond the lower edge 30 of the blade 20 when the spring 32 is not being compressed. The hand gripping material 66 may be rubber or other material.

In use, the user may grasp the grip portion 52 near its upper end in one or both hands and swing the tool downward in a chopping motion. In doing so, pointed portion of wedge 64 at the bottom edge 54 of the blade 44 will first strike the surface of the ice layer to be chopped with sufficient force to compress the spring 32, allowing the rod 36 to retract into the outer tubular handle 12 and a short instant later the bolts or rivets 50 through the slots 46 and 48 of the first blade member 20 will impact the second blade member 44 to further impact the ice. The slots 46 and 48 define the stroke length 75, which is preferably about 2.54 centimeters (1 inch) to about 3.81 centimeters (1.5 inches). In order to prevent damage to the rivets 50 caused by impacts, the energy from the handle 12 is passed to plate 44 by the corners 92 of bracket 16 engaging slanted walls 90 of plate 44. The impact points at 90 and 92 are straight down and at the center of the tubes since bracket 16 and plate 44 are centered on a diameter though the center with respect to the tubes 12 and 36. Further, impacts of the slots 46, 48 on rivets 50 tends to set up a torque and waste energy while pressing the tubes 12 and 36 against each other which may tend to bend the tubes and get them stuck together. The shock of the impact here is better at transferring energy than though the rivets which would tend to bend and fracture under the impacts over time. The impact could also occur at other points along the top of the plate 44 and the bottom of the brackets 16 if desired but the two-point impact transfers the energy more evenly to both sides along the edge 54 of plate 44 and the plates are less likely to become stuck together if there are only two small points of contact particularly with ice and snow present.

It has been found that striking the ice layer in rapid succession sets up vibratory forces in the ice layer that aids in the disintegration thereof. The curved shape of handle 52 provides an ergonomic means for holding the handle 12 at an angle, imparting a scraping motion to the blade assembly for sweeping broken ice chunks away from the site being treated so that the chunks and other particles will not get between the blades 20, 44 and interfere with the impact of the first and second blades in quick succession onto the layer of ice still to be broken up nor interfere with the retracing of the second blade relative to the first by dint of spring 32.

By using the ice-chopping tool at an angle to the surface of the ice the wedge portion 64 of second blade member 44 pushes some of the ice away from the impact zone for scraping the pavement or sidewalk. This stroke moving particles and ice forward helps prevent ice and other particles from getting in between the first blade 20 and the second blade 44 or between the outer tube 12 and the inner tube or rod 36 which may cause jamming because plate 44 blocks the opening between plates 20 and 44.

By making the inner tube 36 at least 30.48 to 45.72 centimeters (12 to 18 inches) in length, the surface engagement between the outer diameter of the inner tube 36 and the inside diameter of the outer tube 12 so that binding does not occur.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. An ice-chopping tool comprising:

a tube having an inner diameter, a proximal end and a distal end, a pair of brackets attached to the distal end of the tube, the brackets being on a diameter of the tube, a first plate attached to the brackets, the plane of the first plate being parallel to the axis of the tube, a pair of apertures in the first plate, a second plate having a bottom edge perpendicular to the axis of the tube, the second plate having a pair of slots parallel to the axis of the tube, the slots slideably connected to the first plate by fasteners passing through the slots and the apertures in the first plate, the second plate in the same plane as the brackets, a second tube attached to the second plate with the second plate extending from the diameter of the tube, the tube having an outer diameter which is smaller than the inner diameter of the tube, wherein the second tube fits into and slides inside of the tube such that the second plate moves relative to the first plate when the second tube moves relative to the tube, a slot in the first plate to allow a space for the second tube to slide up and down in the tube, a pair of slanted contact walls on the second plate for coming into contact with the brackets to stop the upward movement of the second plate, a fastener passing through the tube walls, a compression spring engaging the fastener and the second tube such that when the second tube moves upward in the tube the spring compresses, the upward motion of the second plate relative to the first plate is limited by contact between the second plate and the brackets to provide an impact on the second plate in contact with ice to crack the ice.

2. An ice-chopping tool as in claim 1 having, a hand grip attached at the proximal end of the tube to promote use by easier handing.

3. An ice-chopping tool as in claim 1 having, the bottom edge of the second plate has a wedge to form a sharp edge for cutting into the ice.

4. An ice-chopping tool as in claim 1 wherein, a washer between the first plate and the second plate, on the projections, separates the first plate from the second plate to decrease friction between the plates.

5. An ice-chopping tool as in claim 1 wherein, the washers are lubricated washers.

* * * * *